US007015390B1

(12) United States Patent
Rogers

(10) Patent No.: US 7,015,390 B1
(45) Date of Patent: Mar. 21, 2006

(54) TRIAD PICKUP

(76) Inventor: Wayne A. Rogers, 3554 Hopkins Ave., Titusville, FL (US) 32780

( * ) Notice: Subject to any disclaimer, the term of this patent is extended or adjusted under 35 U.S.C. 154(b) by 154 days.

(21) Appl. No.: 10/758,631

(22) Filed: Jan. 15, 2004

Related U.S. Application Data

(60) Provisional application No. 60/440,135, filed on Jan. 15, 2003.

(51) Int. Cl.
*G10H 3/00* (2006.01)

(52) U.S. Cl. ..... 84/723; 84/1.16; 84/726; 84/743; 84/728

(58) Field of Classification Search ..... 84/723, 84/1, 726, 727, 735, 743, 267, 728, 622; 174/50
See application file for complete search history.

(56) References Cited

U.S. PATENT DOCUMENTS

| | | | | | |
|---|---|---|---|---|---|
| 3,869,952 | A | | 3/1975 | Rowe | 84/1.16 |
| 4,151,776 | A | | 5/1979 | Stich | 84/1.16 |
| 4,245,540 | A | | 1/1981 | Groupp | 84/1.14 |
| 4,501,186 | A | * | 2/1985 | Ikuma | 84/726 |
| 4,872,386 | A | | 10/1989 | Betticare | 84/726 |
| 5,052,269 | A | * | 10/1991 | Young, Jr. | 84/728 |
| 5,438,158 | A | | 8/1995 | Riboloff | 84/727 |
| 5,557,058 | A | | 9/1996 | Lace | 84/735 |
| 5,567,903 | A | * | 10/1996 | Coopersmith et al. | 84/723 |
| 5,637,823 | A | | 6/1997 | Dodge | 84/743 |
| 5,693,898 | A | | 12/1997 | Fishman | 84/267 |
| 5,763,808 | A | | 6/1998 | Thomson | 84/728 |
| 5,837,912 | A | | 11/1998 | Eagen | 84/267 |
| 5,866,834 | A | | 2/1999 | Burke | 84/622 |
| 6,111,184 | A | | 8/2000 | Cloud | 84/723 |
| 6,121,537 | A | * | 9/2000 | Pawar et al. | 84/728 |
| 6,278,059 | B1 | | 8/2001 | Lefton | 174/50 |
| 6,441,293 | B1 | * | 8/2002 | LaBarbera | 84/723 |

* cited by examiner

*Primary Examiner*—David Martin
*Assistant Examiner*—Christina Russell
(74) *Attorney, Agent, or Firm*—Brian S. Steinberger; Law Offices of Brian S. Steinberger, P.A.

(57) ABSTRACT

A removable and portable single pickup unit for stringed instruments such as guitars, and the like. The unit can be mounted inside of a sound hole of an acoustic guitar without damaging the guitar. The unit can combine inputs from three different pickups(such as a magnetic sensor, vibratory transducer, and a microphone) into a single small housing. The unit can include a pre-amplifier and circuitry within the unit along with three rotatable rheostat type control knobs for each of the pickups, and an overall volume control knob that are easily reachable to the user's fingers while the fingers are on the strings. An output cable connects the unit to a single external amplifier or three individual amplifiers for each of the three different pickups.

19 Claims, 11 Drawing Sheets

TRIAD PICKUP

This invention claims the benefit of priority to U.S. Provisional Application 60/440,135 filed Jan. 15, 2003.

FIELD OF INVENTION

This invention relates to pickup mounts for musical instruments, in particular to a combined triad pickup and preamp device that combines a magnetic sound-hole pickup, a transducer vibration pickup and a sound microphone pickup into a single housing, and methods of mounting and using the combined pickup with stringed instruments such as guitars, and connecting the combined pickup to exterior amplifiers, and the like.

BACKGROUND AND PRIOR ART

Pickup blender devices have been used in guitar type stringed instruments and generally require the devices be mounted to the sides of the guitars. These blender devices further generally require slider switches that the user must slide in order to control the pickup devices. Thus, the location of these traditional pickup devices and the slider knob controls are undesirable and impractical to the user. For example, the user must physically remove their fingers from the strings to manipulate the slider type knobs. Additionally, the side mounting of these devices can be destructive to the guitar since a user must cut an opening in the side of a guitar type instrument.

Many of the known pickup blender devices rely on using one or more identical pickup sensors which further restricts the versatility of the device. Furthermore, the blender devices tend to combine the output into single cables that connect to externally mounted amplifiers. Thus, the pickup devices do not allow for much tenability, and do not allow for each of the pickup sensors to be individually tuned.

Throughout the history of acoustic pickup systems there have been three basic types of acoustic pickups: Magnetic Pickup, Transducer Pickup and Under the Bridge Saddle Transducer. Each one has its highlights and flaws and companies have endlessly attempted to engineer the best tone out of each design. The Magnetic Pickup: (Also called a sound-hole pickup.) have been installed in the sound-hole and "pick up" the magnetic responses of the strings-similar to a pickup used on an electric guitar. The pickup's coil windings, pole-piece sizes, and magnet size are all designed to produce the most accurate "acoustic" tone. The magnetic pickup is usually more bass responsive. The pickup actually receives its response from the magnetic steel core of bronze or brass acoustic guitar strings. These pick-ups produce very little feed back, do not normally need a pre-amp, some are portable "pop-ins," and they are the most popular for quick installs and a decent tone.

Transducer pickups sense vibrations. Two types have been popular a stick-on style, which may be placed at different locations on the guitar top, and an Under-The-Bridge-Saddle pickup, which is installed under the bridge saddle. Unfortunately, with stick-on type transducers, the response from the top of the guitar will also pick up unwanted nuances such as finger, pick, and arm noises. The under-The-Bridge-Saddle transducer pickup reduces unwanted noises and has good acoustic tone. The tone is more "trebly" than the magnetic pickup. It may be used with or without a pre-amp. Using a pre-amp will increase the response, and with tone controls can be an excellent choice for a permanent install.

Condenser Microphone pickups have been known to be placed inside the guitar produce very good acoustic tones. However, care must be used because of increased feed back possibilities and the inherent proximity effect. Simply, the proximity effect will tend to produce higher levels of bass tones. Also, for superior tone, a condenser microphone would still must be used and driven by a battery powered pre-amp.

None of the prior art is known to adequately combine the various pickups.

Several patents have been proposed over the years related to pickup mounts for stringed type instruments. See for example, U.S. Patents: U.S. Pat. No. 3,869,952 to Rowe; U.S. Pat. No. 4,151,776 to Stich; U.S. Pat. No. 4,245,540 to Groupp; U.S. Pat. No. 4,872,386 to Betticare; U.S. Pat. No. 5,438,158 to Roboloff; U.S. Pat. No. 5,557,058 to Lace; U.S. Pat. No. 5,637,823 to Dodge; U.S. Pat. No. 5,693,898 to Fishman; U.S. Pat. No. 5,763,808 to Thomson; U.S. Pat. No. 5,837,912 to Eagen; U.S. Pat. No. 5,866,834 to Burke et al.; U.S. Pat. No. 6,111,184 to Cloud et al.; U.S. Pat. No. 6,121,537 to Pawar et al.; and U.S. Pat. No. 6,278,059 to Lefton.

However, none of the prior art adequately solves the problems presented above. Thus, the need exists for solutions to the above problems.

SUMMARY OF THE INVENTION

A primary objective of the present invention is to provide a multi-sensor pickup unit for stringed instruments and method of use that can be mounted without damaging the instrument, and does not require cutting unsightly, tone changing sections or holes.

A secondary objective of the present invention is to provide multi-sensor type pickup unit for stringed instruments and method of use that can be removably mounted in the sound hole.

A third objective of the present invention is to provide a multi-sensor type pickup unit for stringed instruments and method of use having controls adjacent to the strings within easy reach of the user.

A fourth objective of this invention is to provide a multi-sensor type pickup unit for stringed instruments and method of use having easily adjustable non-slider controls for the unit.

A fifth objective of the present invention is to provide a multi-sensor type pickup unit for stringed instruments and method of use having three different non-identical pickup sensors.

A sixth objective of the present invention is to provide a multi-sensor type pickup unit for stringed instruments and method of use that provides separate tuning for each pickup sensor.

A seventh objective of the present invention is to provide a multi-sensor type pickup unit for stringed instruments and method of use that can include separate inputs for treble, middle and bass for each pickup sensor.

An eighth objective of the present invention is to provide a magnetic pickup for stringed instruments having an extremely low noise, and a single coil with individual string adjustments for balanced tone.

A ninth objective of the present invention is to provide an Under-The-Bridge-Saddle type (piezo-electric) transducer for a stringed instrument having independent response of each string, with a casing that provides a level surface for equal string volume.

A tenth objective of the present invention is to provide a high quality Condenser microphone for a stringed instrument that can be located the pickup device.

An eleventh objective of the present invention is to provide a pickup system for stringed instruments that can use Gold plated pole pieces, connectors, and End-Pin Jack.

A twelfth objective of the present invention is to provide a pickup system for stringed instrument having a pre-amp system that is conveniently "hidden" within the pickup assembly.

A thirteenth objective of the present invention is to provide a pickup system for stringed instruments that is easy to install, does not require soldering, and can be installed quickly within up to approximately 30 to approximately 45 minutes.

A fourteenth objective of the present invention is to provide a pickup system for stringed instruments that can be easily removed, as all components can use plug-style connectors.

A fifteenth objective of the present invention is to provide a pickup system for stringed instruments having easily reached volume controls for onboard adjustments.

A sixteenth objective of the present invention is to provide for multi-pickup sensors for a stringed instrument such as a guitar that includes controls that are easily reachable to the user's fingers while the fingers are on the strings of the instrument.

The novel triad pickup invention can utilize all three types of acoustic amplification devices that were described in the background section of the invention: a superior Magnetic pickup, a superb Under-The-Bridge-Saddle transducer pickup, and a high quality Condenser Microphone which is located inside triad device. The invention incorporates three separate pickups and a preamp, all part of one housing.

The novel triad pick-up system can include a main housing for being removably mounted into a sound hole of a stringed instrument, such as an acoustic guitar. Three different pickup sensors, such as a piezo-electric transducer, a microphone, and a magnetic sensor can be connected to the housing. The novel triad unit housing can include four easily reachable blender volume controls on the sides of the housing(two on each side) so that the performer can easily blend each pickup into a mono output. The unit housing can be attached to a power supply such as a 9 volt battery, and the like, and the mono signal can be easily amplified using a ¼ inch phonotype cable.

Further objects and advantages of this invention will be apparent from the following detailed description of the presently preferred embodiments which are illustrated schematically in the accompanying drawings.

DESCRIPTION OF THE PREFERRED EMBODIMENTS

Before explaining the disclosed embodiments of the present invention in detail it is to be understood that the invention is not limited in its application to the details of the particular arrangements shown since the invention is capable of other embodiments. Also, the terminology used herein is for the purpose of description and not of limitation. A list of the components used in the figures is given below.

1 Instrument
2 Saddle
5 Bridge
10 Strings
12 Triad Pickup Device
15 Housing
20 Soundboard Surface
25MG Magnetic Transducer Potentiometer Knob
25PI Piezoelectric Transducer Potentiometer Knob
25MC Microphone Transducer Potentiometer Knob
25MAS Master Potentiometer Knob
30 Clamping Screw
35 Sound Hole
40 Magnet Pole Screw
43 2 Conductor Cable
45 Output Jack
50 Battery
55 Battery Connector Harness
60 Inside Soundboard Surface
65 Piezo Pickup Connector Harness
70 Output Connector Harness
75 Microphone
80 Clamp

Figure 1:
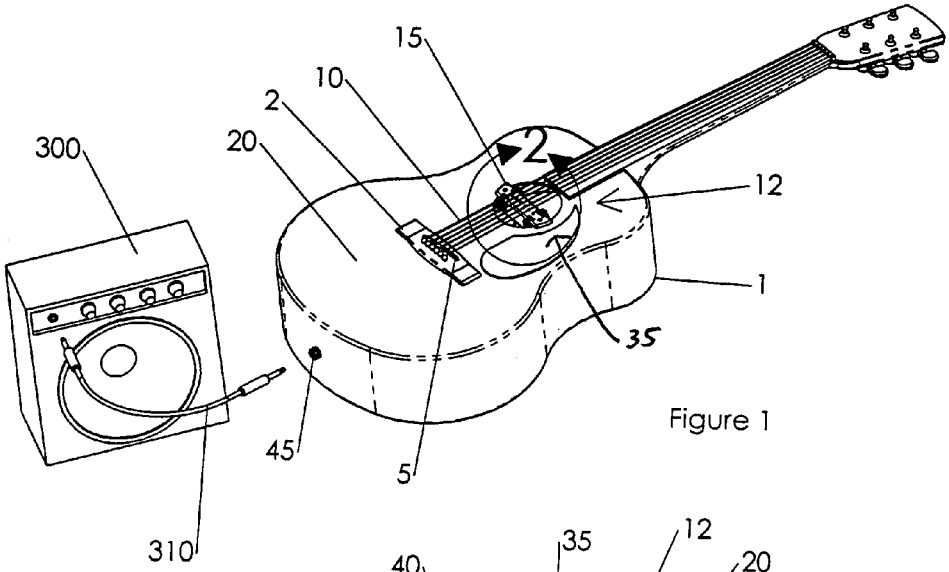
FIG. 1 is a perspective exterior view of a guitar with the novel triad pickup device.
Figure 2:
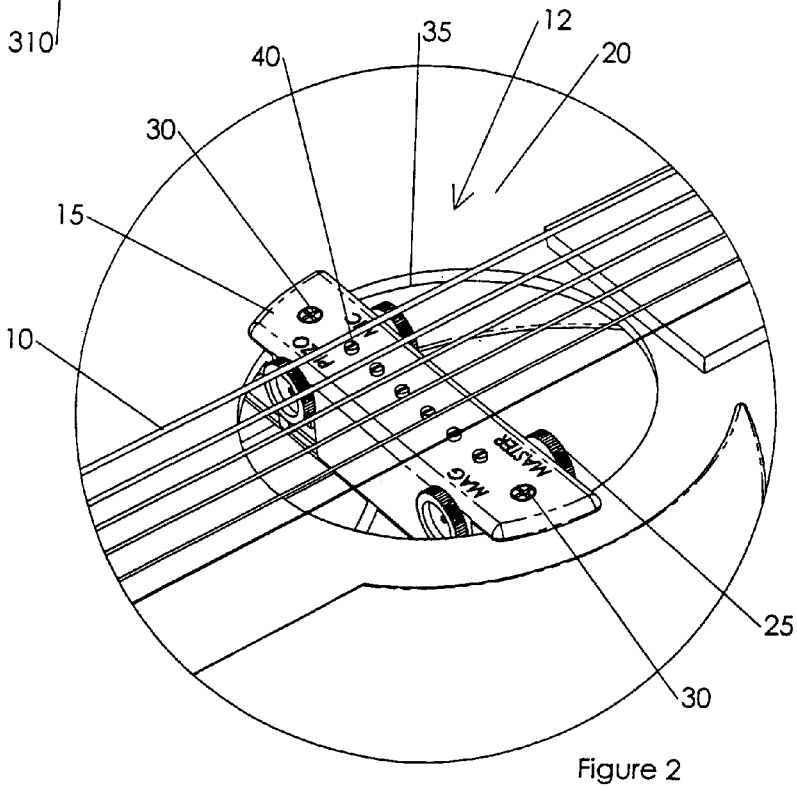
FIG. 2 is an enlarged view of the triad pickup device mounted in the music box in FIG. 1.
Figure 3:
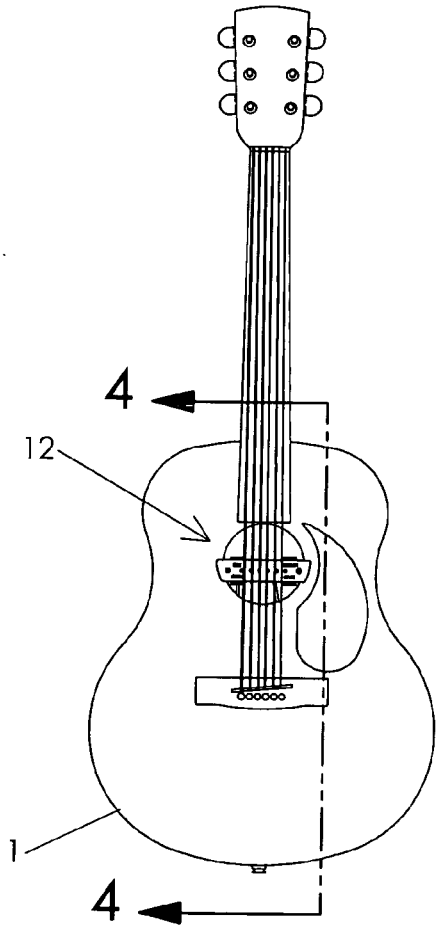
FIG. 3 is a front view of the guitar of FIG. 1 with mounted triad pickup device.
Figure 4:
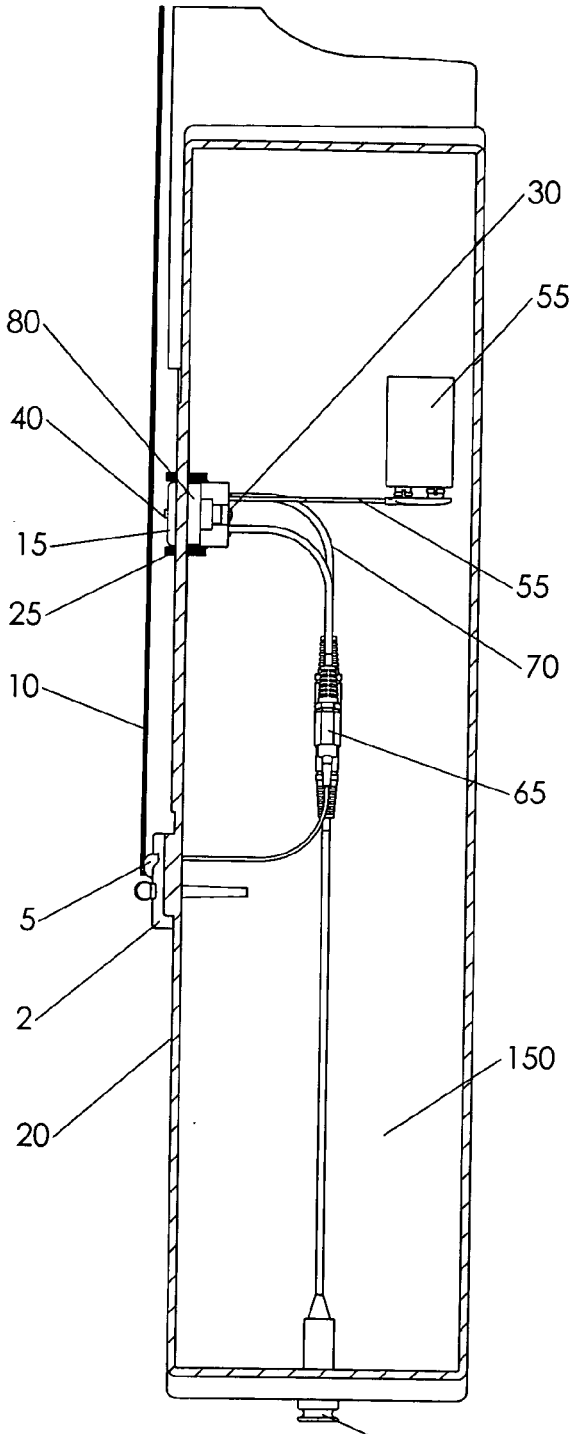
FIG. 4 is a side cross-sectional view of the guitar of FIG. 3 along arrow 4.
Figure 5:
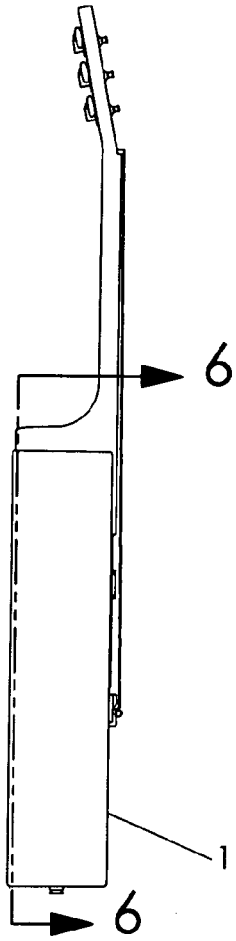
FIG. 5 is a side view of the guitar of FIGS. 1, 3.
Figure 6:
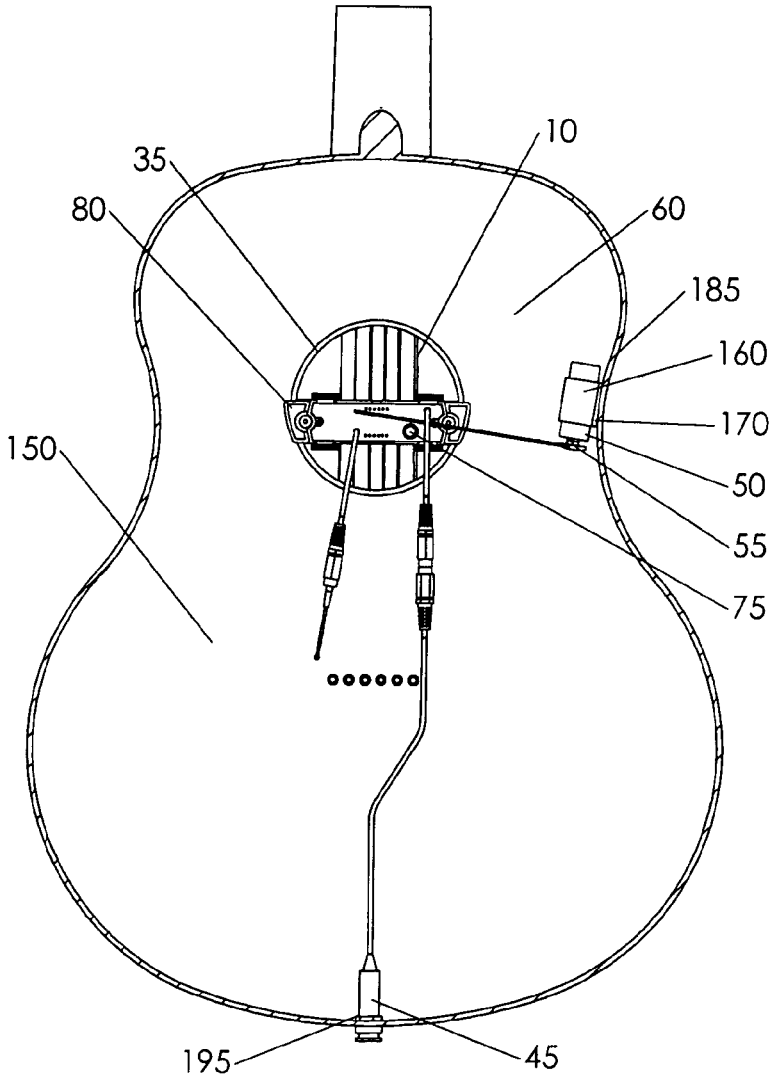
FIG. 6 is a cross-sectional view of the guitar of FIG. 5 along arrow 6.
Figure 7:
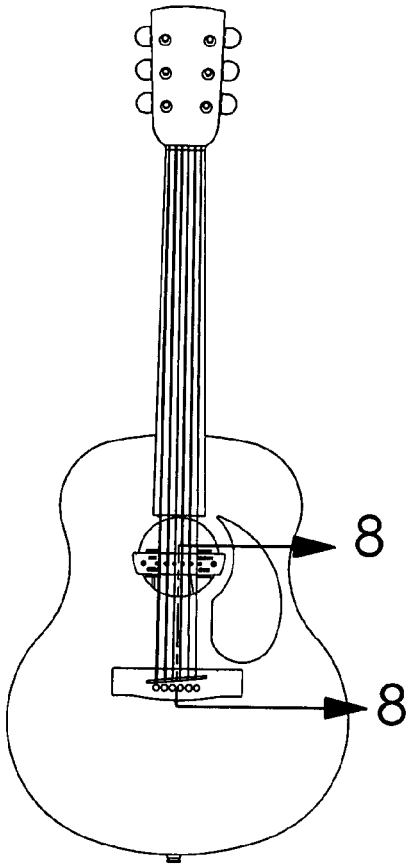
FIG. 7 is another front view of the guitar of the preceding figures.
Figure 8:
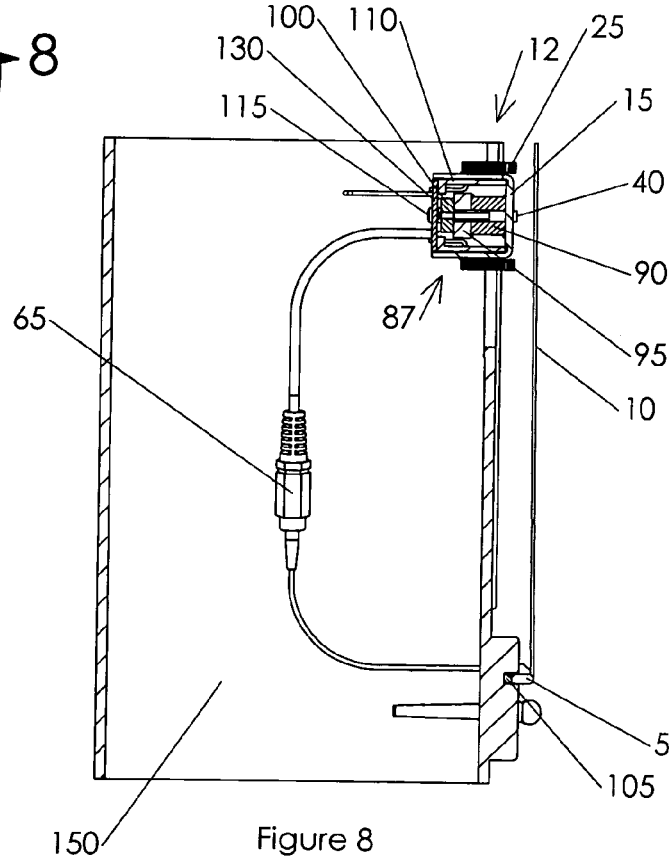
FIG. 8 is an enlarged cross-sectional view of the mounted triad pickup device in the guitar of FIG. 7 along arrow 8.
Figure 9:
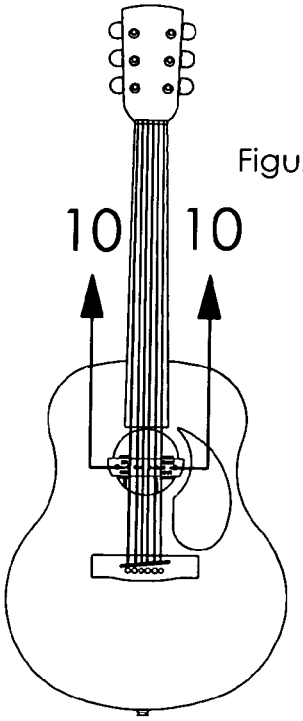
FIG. 9 is another front view of the guitar of the preceding figures.
Figure 10:
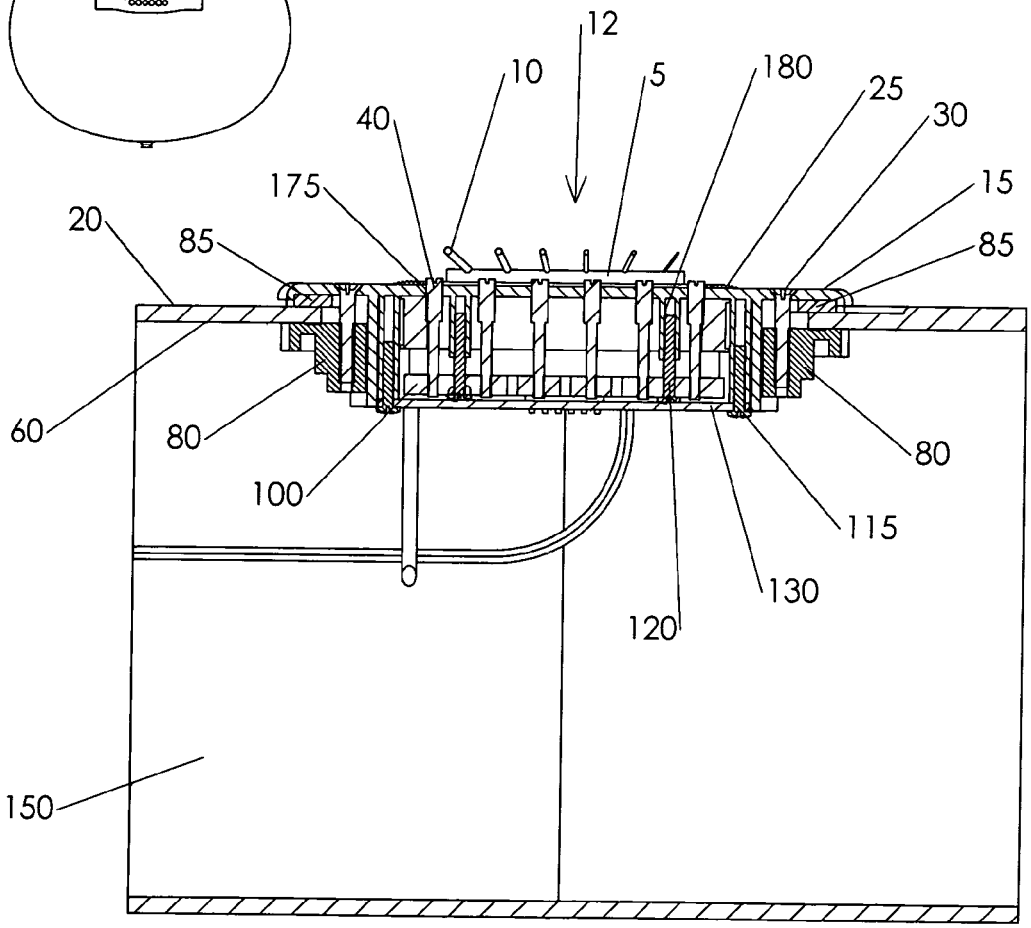
FIG. 10 is an enlarged cross-sectional view of the mounted triad pickup device in the guitar of FIG. 9 along arrow 10.
Figure 11:
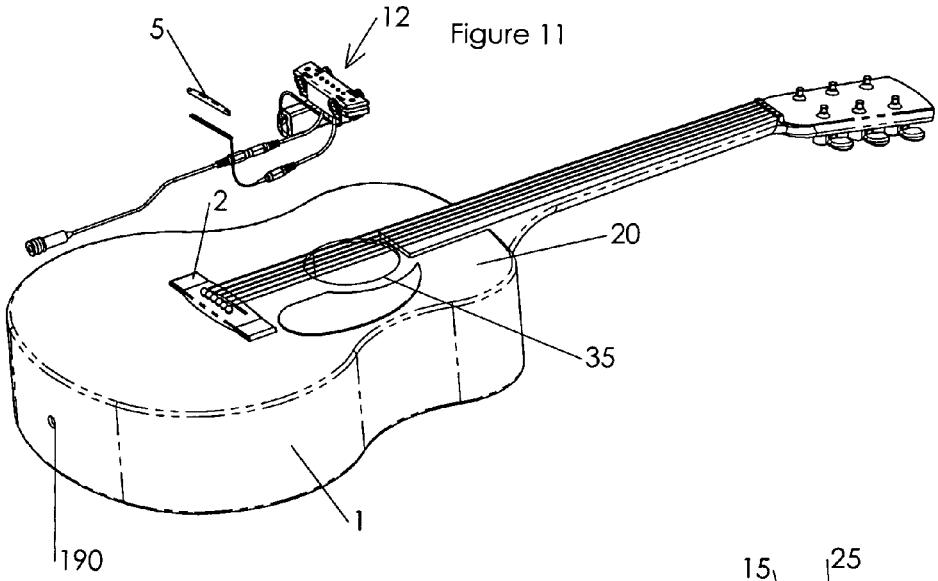
FIG. 11 shows the novel triad pickup device separated from the music box of the guitar of the preceding figures.
Figure 11A:
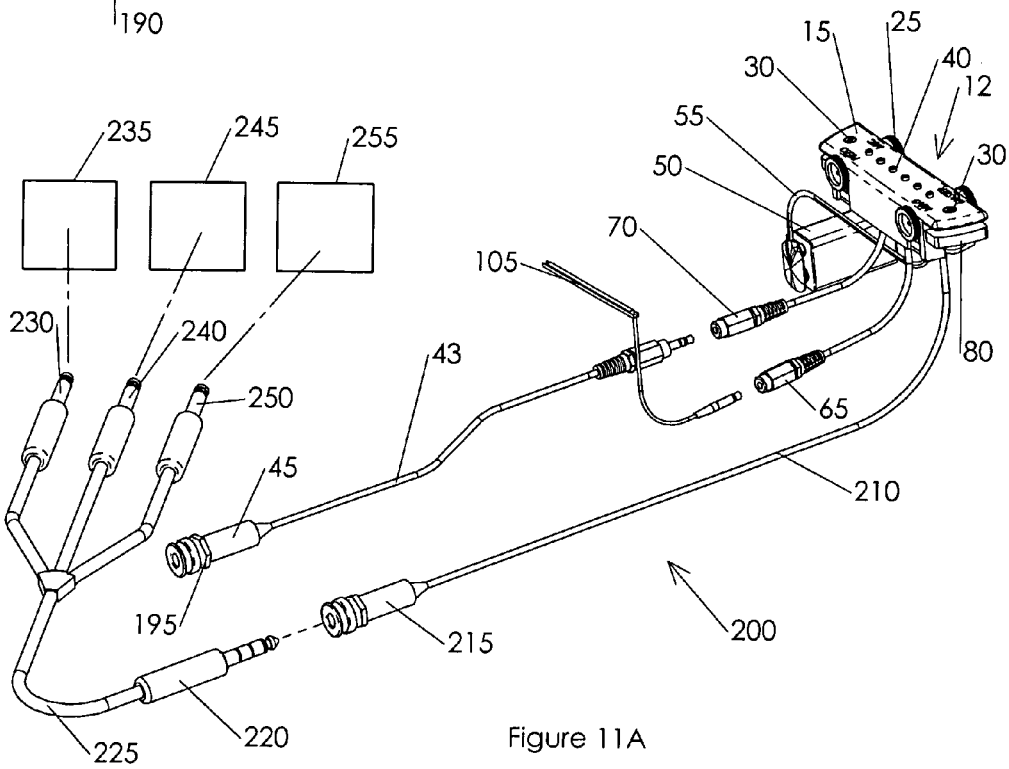
FIG. 11A is an enlarged view of the separated triad pickup device of FIG. 11.
Figure 12:
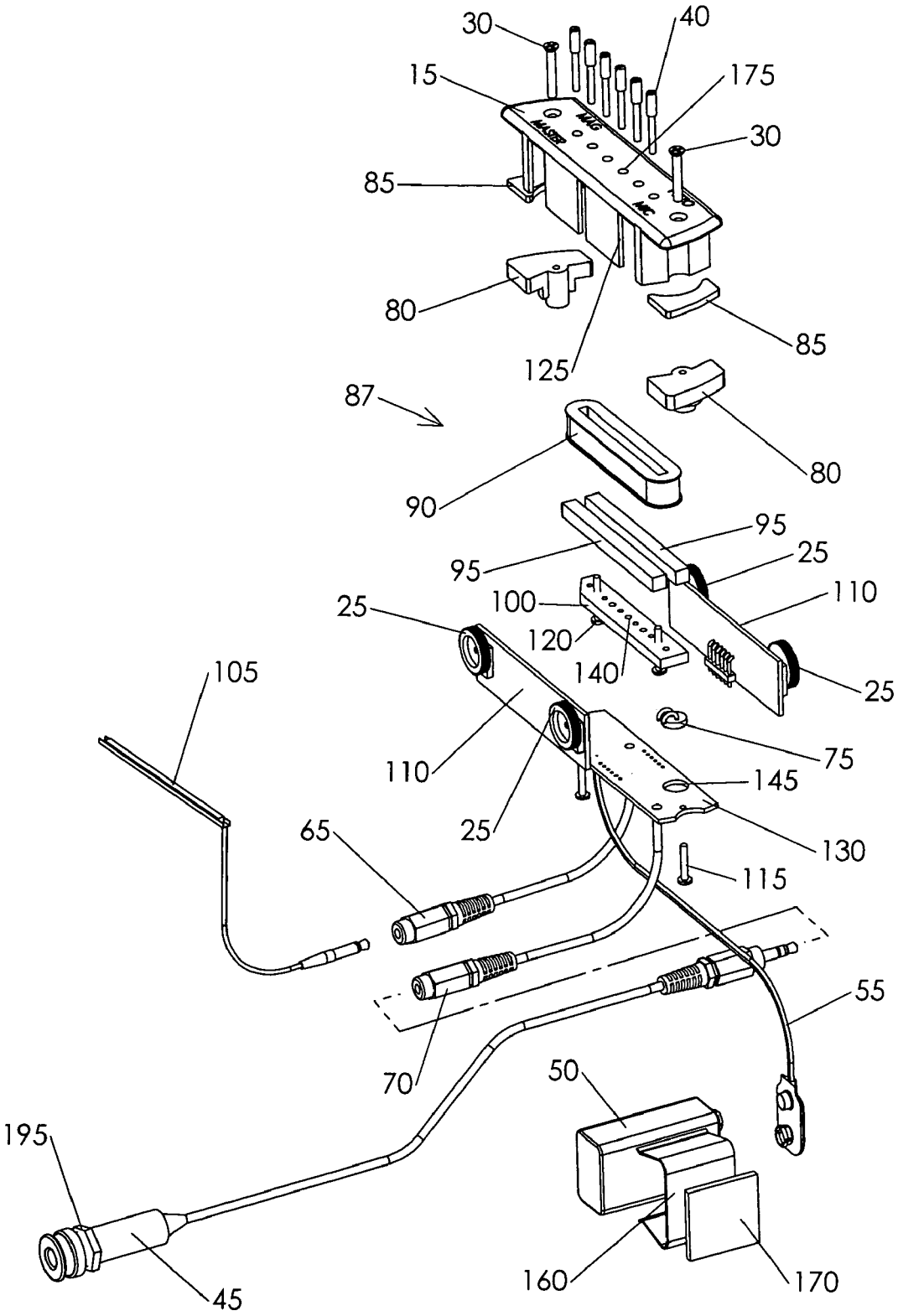
FIG. 12 is an exploded view of the novel triad pickup device of the preceding figures.
Figure 14:
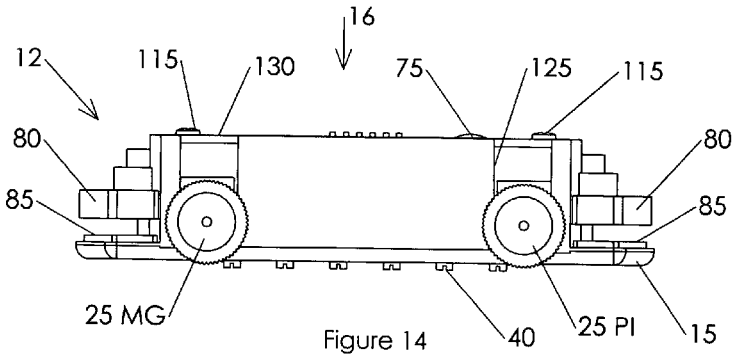
FIG. 14 is a top view of the main housing of FIG. 13 along arrow 14.
Figure 13:
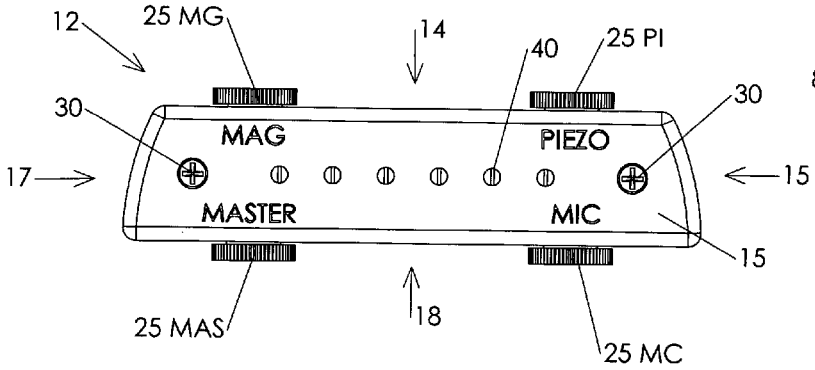
FIG. 13 is a front view of the main housing of the triad pickup device.
Figure 15:
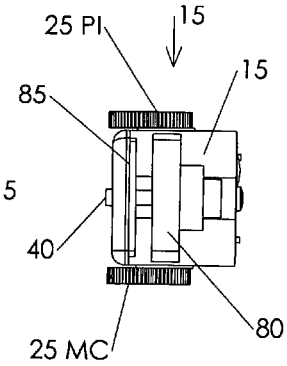
FIG. 15 is a right side view of the main housing of FIG. 13 along arrow 15.
Figure 17:
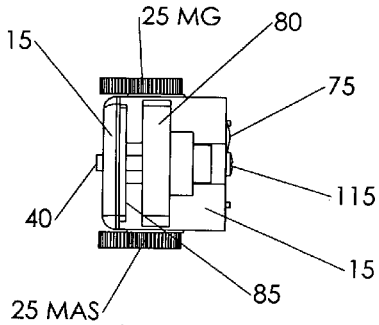
FIG. 17 is a left side view of the main housing of FIG. 13 along arrow 17.
Figure 16:
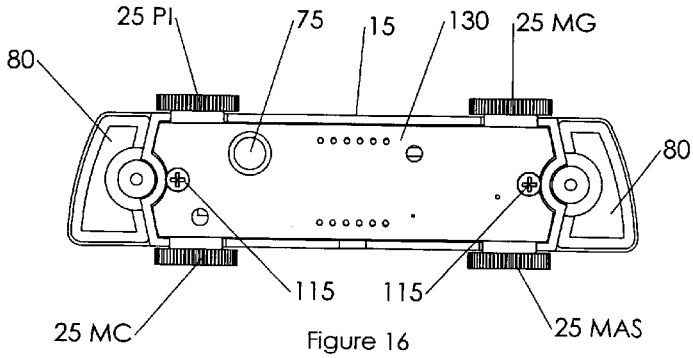
FIG. 16 is a rear view of the main housing of FIG. 14 along arrow 16.
Figure 18:
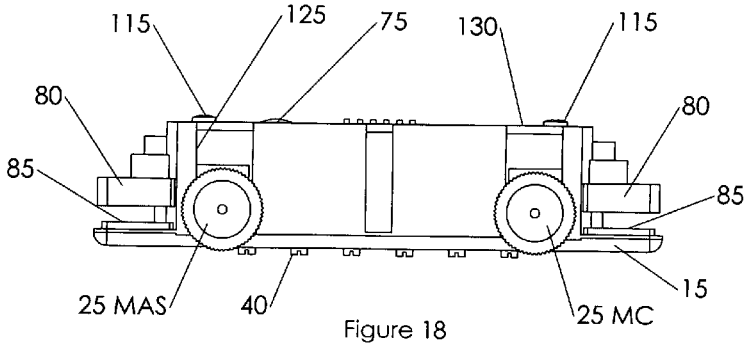
FIG. 18 is a bottom view of the main housing of FIG. 13 along arrow 18.

85 Elastomer Pad
87 Magnetic Transducer
90 Coil
95 Magnet
100 Adjustment Bar
105 Piezo Transducer
110 Control Circuit Board
115 Preamp Board Retainer Screw
120 Coil Retainer Screw
125 Housing Slot
130 Preamp Board
135 Threaded Body
140 Threaded Aperture
145 Microphone Aperture
150 Resonator Cavity
160 Battery Clip
170 Adhesive Pad
175 Magnet Pole Screw Aperture
180 Screw Boss
185 Inside Wall
190 Output Jack Aperture
195 Output Jack Nut
200 Triple Output Connector
210 Hard Wired Cable to Housing
215 4 Conductor Output Jack
220 4 Conductor Jack
225 External Cable
230 Microphone Output
240 Piezo Transducer Output
250 Magnetic Transducer Output
300 External Amplifier
310 Cable to Amplifier FIG. 1 is a perspective exterior view of a stringed instrument 1 such as a guitar, and the like, with the novel triad pickup device 12. FIG. 2 is an enlarged view of the triad pickup device 12 mounted in the music box 35 in FIG. 1. FIG. 3 is a front view of the guitar 1 of FIG. 1 with mounted triad pickup device 12. FIG. 4 is a side cross-sectional view of the guitar 1 of FIG. 3 along arrow 4. FIG. 5 is a side view of the guitar 1 of FIGS. 1, 3. FIG. 6 is a cross-sectional view of the guitar 1 of FIG. 5 along arrow 6. FIG. 7 is another front view of the guitar 1 of the preceding figures. FIG. 8 is an enlarged cross-sectional view of the mounted triad pickup device 12 in the guitar 1 of FIG. 7 along arrow 8. FIG. 9 is another front view of the guitar 1 of the preceding figures. FIG. 10 is an enlarged cross-sectional view of the mounted triad pickup device 12 in the guitar 1 of FIG. 9 along arrow 10. FIG. 11 shows the novel triad pickup device 12 separated from the music box of the guitar 1 of the preceding figures. FIG. 11A is an enlarged view of the separated triad pickup device 12 of FIG. 11. FIG. 12 is an exploded view of the novel triad pickup device 12 of the preceding figures. FIG. 13 is a front view of the main housing 15 of the triad pickup device 12. FIG. 14 is a top view of the main housing 15 of FIG. 13 along arrow 14. FIG. 15 is a right side view of the main housing 15 of FIG. 13 along arrow 15. FIG. 16 is a rear view of the main housing 15 of FIG. 14 along arrow 16. FIG. 17 is a left side view of the main housing 15 of FIG. 13 along arrow 17. FIG. 18 is a bottom view of the main housing 15 of FIG. 13 along arrow 18.

Referring to FIGS. 1–18, the novel musical instrument audio triad pickup device 12 provides a system to allow three different transducers 75(FIG. 6), 87(FIG. 8), 105(FIG. 11A) to be located at three different locations within a stringed instrument 1, such as a guitar, and the like. Due to the mechanical variations of the construction of most instruments, audio frequencies and harmonics are attenuated or enhanced based on the location of the sampling transducer. This invention incorporates a microphone 75(FIG. 6) inside the sound cavity 35 of an instrument 1, to capture the acoustic wave pressures as a function of the string(10) energy absorbed in the sound board 20 of the instrument 1, a piezo pressure transducer 105 to directly detect the mechanical resonate energy of the string at the bridge 5, and a magnetic transducer 87 to detect string (10) motion.

These transducers 75, 87, 105 can be connected to a battery-powered 50 preamp 130 built into the body of the device 12. The preamp circuitry 130 allows the player to proportionally control the output levels of these sampling transducer's signals and output this signal to an external audio amplifier 300 as a mixed signal or as a separate channel for each transducer. This allows a broad range of audio frequencies to be adjusted by the player to be more pleasing the listener. The player can manipulate these controls 25MG, 25PI, 25MC and 25MAS on the main body 15 of the device 12 clamped in the sound hole 35 of the instrument 1. The output is made accessible through a connector jack 45 in the side wall of the instrument 1. This device 12 can be field-installable by the player as an after-market modification.

Installation of Triad Device 12

Referring to FIGS. 1, 6, 12 and 14, the triad device can be installed in a normal operating position, in instrument 1, with strings 10 in proximity of the magnetic pole screw 40. The housing 15 can be clamped into sound hole 35 on sound board surface 20 by clamp 80 contacting the inside soundboard surface 60 and held in position by a fastener such as a clamping screw 30, wherein the clamp 80 sandwiches a portion of the sound board edge therebetween. An elastomer pad 85 can be placed between the housing 15 and the sound board surface 20 to prevent slippage and to protect the sound board surface. The housing 15 can include a size of no more than approximately 4¼ inches by approximately 1 inch high by approximately 1 inch deep so as to be easily fit into a sound hole 35 of a stringed instrument 1 without having to damage the instrument.

Magnetic Transducer 87

Referring to FIGS. 10 and 12, a magnetic transducer 87 can include a magnet 95, in close proximity to magnetic pole screw 40, that induces magnetic flux through magnetic pole screw 40 and onto ferrous string 10. The instrument string 10, which is set in motion by the player can vibrate within this flux concentration, causing the magnetic field through the magnetic pole screw 40 to vary in close proximity to coil 90. This flux variation causes current flow proportional to the string 10 vibration in coil 90. A resulting electrical signal is sent to the preamp board 130 for signal processing. The magnetic pole screw 40 can be adjusted for string height variations and optimum flux concentration by turning the threaded body of magnetic pole screw 40 into the threaded aperture 140 in the adjustment bar 100. This adjustment can raise or lower magnetic pole screw 40 relative to the instrument string 10.

Piezo Transducer 105

Referring to FIG. 8, the piezo transducer 105 can be located under bridge 5. The string 10, set in motion by the player, vibrates, which propagates through bridge 5 and onto Piezo transducer 105. When piezoelectric material in the piezo transducer 105 is compressed by this vibration, an electric charge collects on its surface which is proportional to the instrument string 10 vibration. This electrical signal can be sent to the FIG. 12 preamp board 130 via piezo pickup connector harness 65 for signal processing.

Microphone Transducer 75

Referring to FIGS. 6 and 12, a microphone 75 is press-fitted into a microphone aperture 145 on interface board 130. (This is located within the confines of the resonator cavity 150.) The instrument string 10, set in motion by the player, vibrates, which propagates through bridge 5, through the saddle 2 and onto the soundboard surface 20. This vibrating motion translates to acoustic wave energy in the resonator cavity 150, which is detected by microphone 75, creating an electrical signal sent to the interface board 130 for signal processing.

Operation

Figure 19:
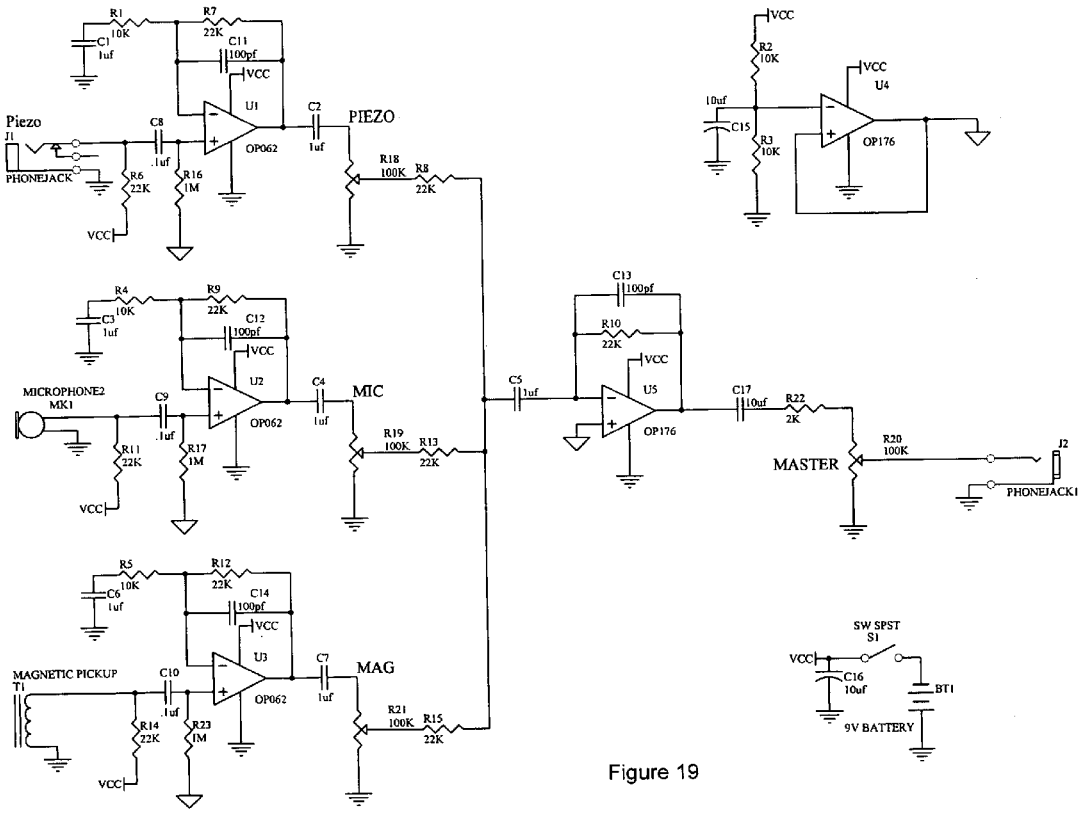
FIG. 19 is a schematic of the circuit configuration for all input signals from the transducer pickup, microphone pickup and magnetic pickup as a triad pickup sensors to be amplified and mixed into one composite output signal.
Figure 20:
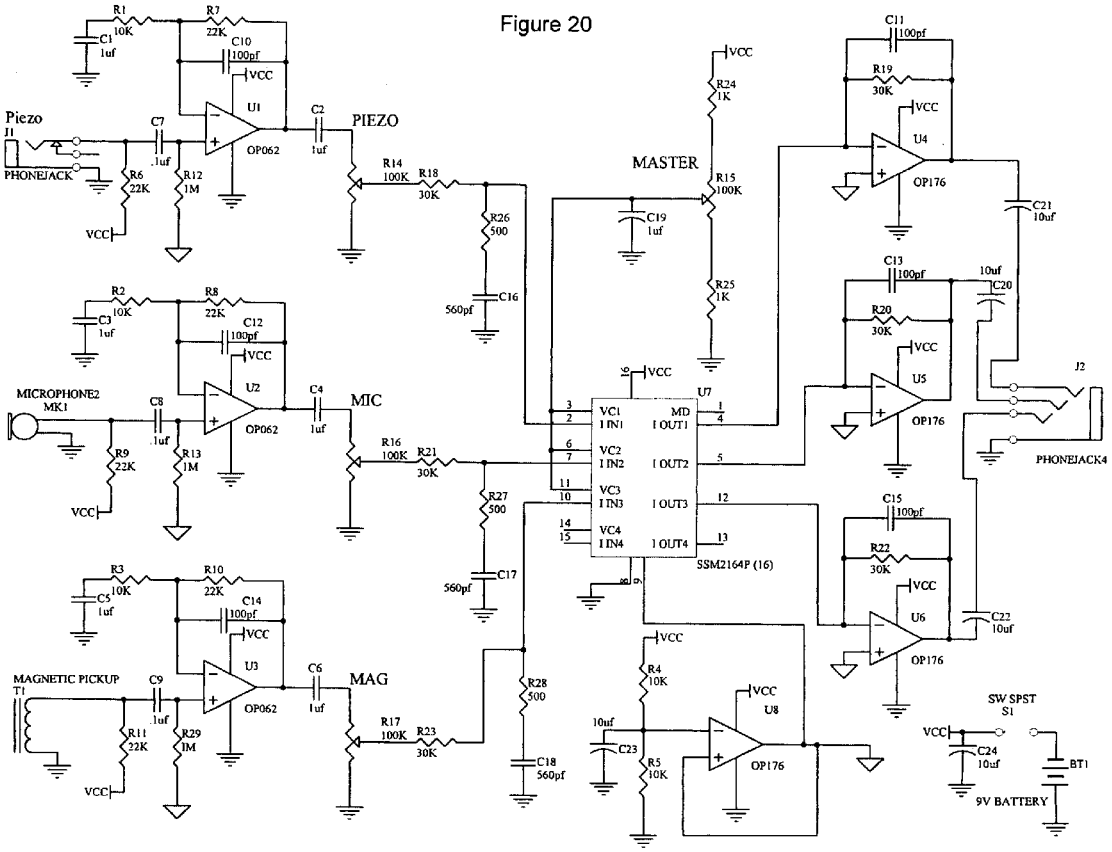
FIG. 20 is a schematic of the circuit configuration of FIG. 19 for all input signals from the triad pickup sensors to be amplified and the transducer signals to be output individually.

Referring to FIGS. 12, 19, and 20, the signal for microphone 75, piezo transducer 105 and magnetic transducer 87(magnetic coil 90) can be sent to the preamp board 130 for signal processing. The FIG. 19 schematic shows the circuit configuration for all input signals to be amplified and mixed into one composite output signal. The FIG. 20 schematic shows the circuit configuration for all input signals to be amplified and the transducer signals to be output individually.

Referring to FIGS. 1–18, the proportion of the transducer signal strength is controlled by one transducer potentiometer 25MG, 25PI, 25MC, dedicated to each transducer, and one master volume potentiometer 25MAS for volume. The signal levels are controlled by the player turning the potentiometer knob 25MG, 25PI, 25MC attached to each potentiometer. The knobs 25MG, 25PI, 25MC and 25MAS can be disc shaped with raised knurled edges for easy turning by the user. The location of the knobs allows the user to use one finger to turn the knobs to desired settings. The knob controls are easily reachable to the user's fingers while the fingers are on the strings. The device 12 is powered by battery 50 such as a 9 volt battery connected to preamp board 130 by battery connector harness 55 located in resonator cavity 150. The battery 50 is secured by battery clip 160 and adhesive pad 170 attached to the inside wall 185 of the resonator cavity 150. The output signal is sent to the output jack 45 via the output connector harness 70. Output jack 45 from 2 conductor cable 43 is attached to the inside wall 185 of the resonator cavity 150 and secured with output jack nut 195.

Referring to FIGS. 12, 16 and 18, the housing 15 holds magnetic pole screw 40 in the position in the Magnet Pole Screw Aperture 175, a molded feature of the housing 15. Magnetic pole screw 40 is also constrained by the adjustment bar 100 which clamps the coil 90 and magnets 95 by means of the coil retainer screws 120 and screw boss 180, a molded feature of housing 15. The control circuit board 110 is held in place by the housing slot 125 in housing 15 and is soldered to the preamp board 130. The preamp board 130 is secured to housing 15 by preamp board retainer screw 115 and screw bosses, a molded feature of housing 15.

Referring to FIGS. 1 and 13–18, each of the four volume controls, 25MG, 25PI, 25MC and 25MAS, on the triad device 12 can include volume indication setting levels. In a preferred embodiment on each control, there can be three settings for volume indicators. For example, One hash mark can be equal to zero volume; two hash marks can be equal to approximately 50% volume; and three hash marks can be equal to approximately 100% volume. By first using the three pickup volume controls 25MG, 25PI, 25MC, an infinite number of blends can be attained. Once the desired tone is achieved, the overall volume can then be controlled by the master control 25MAS.

In order to start using the triad pickup device 12, all the controls 25MG, 25PI, 25MC and 25MAS should be turned to their lowest setting. Next, a high quality, low capacitance type cable 310 should be used to connect the stringed guitar instrument 1 to an external amp 300. Blending the output of the stringed instrument can include the following steps:

1. Adjust the MASTER control, 25MAS to approximately ⅔ volume.
2. Adjust the MIC control 25MC to a comfortable level, somewhere around approximately 50%. If feedback is heard, then lower control slightly. This microphone tone will sound very acoustic and can actually be used independently.
3. Adjust the PIEZO control 25PI until you hear brilliant higher tones with good acoustic quality. This control can be adjusted slightly higher than the MIC control 25MC.
4. Adjust the MAG control 25MG until you hear deep lows, a strong mid-range, and plenty of sustain. With all three pickups now functioning, you will only need to fine tune your settings to the room acoustics.
5. Adjust the master volume 25MAS which controls overall volume control for all 3 pickups to a desired playing volume.

Although the preferred embodiment described in reference to FIG. 1 shows a mono output with a single external amplifier 300 that is attached to the pickup device 12 by line 310 to a 2-conductor stereo output plug 195(FIG. 11A), the invention can be modified for three pickup amplifier sound 200. The novel triad pickup device 12 can be connected to three separate external amplifiers 235, 245, 255 through output jacks 230 for each of the microphone transducer, 240 for the piezo transducer, and 250 for the magnetic transducer, so that each pickup can be connected to its own amplifier. Thus, each pickup can be tone modified for the best possible sound.

A 4-conductor cable line 210 can be hard wired directly to housing 15 with a 4 conductor output jack 215. A 4 conductor jack 220 can connect output jack 215 to three separate outputs 230, 240, 250 by an external cable 225. Microphone Output jack 230, Piezo Transducer Output jack 240 and Magnetic Transducer Output jack 250 can then be connected to respective external amplifiers 235, 245, 255 so that each of the pickup transducers can each be individually tone modified for sound.

The invention can also include separate inputs for treble, middle and bass for each of the pickup transducers.

Although the preferred embodiment references three volume settings for each of the volume knob controls, the invention can include other numbers of settings, such as for example up to approximately nine settings (0, 1, 2, 3, 4, 5, 6, 7, 8, 9)

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A pickup unit for stringed instruments, comprising:

a single removable pickup housing adapted to be mounted within a sound hole of a stringed instrument, the housing having a top surface facing strings on the instrument, a left side, a right side, a front end side and a rear end side, and a bottom surface, the top surface and the bottom surface having a vertical axis passing therethrough;

three pickup sensors on the stringed instrument connected to the pickup housing;

three rotatable tuning members knobs for each of the pickup sensors attached on the housing being easily adjustable by a user of the instrument, the three rotatable knobs located on at least one of the left side and right side of the pickup housing, the rotatable knobs having an axis of rotation perpendicular to the vertical axis passing through the top surface and the bottom surface; and a connector for connecting the pickup housing to an external amplifier, wherein the pickup unit is adapted when installed in the sound hole so that a user's fingers are reachable to the rotatable knobs while the user's fingers are on strings across the sound hole of the stringed instrument.

2. The pickup unit of claim 1, wherein the stringed instrument includes: an acoustic guitar.

3. The pickup unit of claim 1, wherein the three pickup sensors include:

a magnetic sensor, a piezoelectric transducer, and a microphone.

4. The pickup unit of claim 1, further comprising:

a master volume control for controlling overall volume of the three pickup sensors with a single rotatable knob.

5. The pickup unit of claim 4, wherein the rotatable tuning members knobs include:

two rotatable knobs side mounted to the left side and two rotatable knobs side mounted to the right side, one rotatable knob for the master control volume, a second rotatable knob for the magnetic sensor, a third rotable knob of the piezoelectric transducer and a fourth rotatable knob for the microphone, each of the side mounted knobs having knurled edges so that only one finger is needed to rotate the knobs.

6. The pickup unit of claim 1, further comprising:

clamps for mounting both the front end side and the rear end side of the pickup unit to interior edges inside of the sound hole of the stringed instrument; and a padded surface portion on the clamps, so that mounting the pickup unit with the clamps does not result in causing damage to the stringed instrument, the clamps for orienting the pickup unit so that the rotatable knobs are not underneath strings; and screwable members for compressing the clamps about the interior edge of the sound hole of the stringed instrument.

7. The pickup unit of claim 1, wherein the housing includes:

dimensions of no greater than approximately 4¼ inches wide by approximately 1 inch high by approximately 1 inch deep.

8. The pickup unit of claim 1, wherein the rotatable knobs are mounted to at least one of the left side and the right side of the pickup unit adjacent to at least one of the front end side and the rear end side, the rotatable knobs being mounted beneath and away from the strings on the instrument so that fingers of the user do not have to pass between the strings to reach the rotatable knobs.

9. A method of adjusting a broad range of audio frequencies emanating from an instrument with strings, a bridge, a sound board and a sound box hole, comprising the steps of:

providing a single pickup unit with an upper surface, a left side, a right side, a front end, a rear end, and a rear surface;

positioning at least three rotatable control knobs on at least one of the left side and the right side of the unit, the control knobs for adjusting at least three different sensors;

mounting both the front end and the rear end of the pickup unit with clamping members to interior edges of the sound box hole without causing damage to the instrument;

sensing acoustic wave pressures absorbed in the sound board of the stringed instrument through one of the different sensors;

detecting mechanical resonate energy from the bridge of the string instrument through another of the different sensors;

detecting motion of the string in the string instrument through still another of the different sensors; and combining the sensing step, the mechanical resonate energy detecting step and the string motion detecting step for connection to an exterior amplifier.

10. The method of claim 9, wherein the mounting step further includes the step of:

orienting the pickup unit so that the three rotatable knobs are not located directly beneath strings overlaying the sound box hole; and locating the pickup unit so that the three rotatable knobs are reachable while the user's fingers are on the strings overlaying the sound box hole of the stringed instrument.

11. The method of claim 10, wherein the mounting step includes the step of:

clamping edges of the sound board adjacent to the sound box through padded members on the clamping members to the front end and the rear end of the single unit.

12. The method of claim 9, wherein the sensing step includes the step of: providing a condenser microphone for the sensing step, the mechanical resonate energy detecting step includes the step of: providing a piezo pressure transducer, the string motion detecting step includes the step of: providing a magnetic transducer.

13. The method of claim 9, further comprising the step of:

individually controlling the sensing step, the mechanical resonate energy detecting step and the string motion detecting step with separate rotatable knobs.

14. The method of claim 9, further comprising the step of:

controlling overall volume of the sensing step, the mechanical resonate energy detecting step and the string motion detecting step, with a single rotatable knob.

15. The method of claim 9, further comprising the step of:

individually controlling the sensing step, the mechanical resonate energy detecting step and the string motion detecting step with three separate rotatable knobs; and controlling overall volume of the sensing step, the mechanical resonate energy detecting step and the string motion detecting step, with a fourth rotatable knob, wherein two of the rotatable knobs are located on one of the left and the right sides of the housing and another two of the rotatable knobs are located on an opposite side.

16. The method of claim 9, further comprising the step of:

orienting rotational axes of the knobs to be perpendicular to a vertical axis passing from the upper surface to the rear surface of the pickup unit.

17. A pickup unit for use with stringed instruments, comprising:

a single removable pickup housing adapted to be mounted within a sound hole of a stringed instrument behind strings that lay across the sound hole, the housing having a top surface facing the strings on the instrument, a left side, a right side, a front end side and a rear end side, and a bottom surface, the top surface and the bottom surface having a vertical axis passing therethrough;

a pickup sensor on the stringed instrument connected to the pickup housing; and a rotatable tuning knob for tuning the pickup sensor being mounted to a side face of at least one of the left and right sides of the pickup housing, the rotatable knob being located adjacent to at least one of the front end side and the rear end side, the rotatable knob having an axis of rotation perpendicular to the vertical axis passing through the top surface and the bottom surface, the rotatable knob being located beneath and away from the strings on the instrument so that fingers of the user do not have to pass between the strings to reach the rotatable knob, and so that a single finger of a user's hand can reach the rotatable knob while the user's hand remains stationary over the strings that are across the sound hole of the stringed instrument; and separate adjustable clamping members for solely clamping both the front end side and the rear end side of the housing of the pickup unit to interior edges inside of the sound hole of the stringed instrument.

18. The pickup unit of claim 17, wherein the adjustable clamping members each include:

a resilient surface portion on the adjustable clamping members, so that mounting the pickup unit with the adjustable clamping members does not result in causing damage to the stringed instrument, the adjustable clamping members for orienting the pickup unit so that the rotatable knob is not directly beneath the strings; and a screwable member for compressing the adjustable clamping members about the interior edges of the sound hole of the stringed instrument.

19. The pickup unit of claim 17, further comprising:

a second pickup sensor on the stringed instrument connected to the pickup housing; and a second rotatable tuning knob for tuning the second pickup sensor being mounted to another side face of at least one of the left and right sides of the pickup housing opposite the side face where the first rotatable tuning knob is located, the second rotatable knob being located adjacent to at least one of the front end side and the rear end side, the second rotatable knob having an axis of rotation perpendicular to the vertical axis passing through the top surface and the bottom surface, the second rotatable knob being located beneath and away from the strings on the instrument so that fingers of the user do not have to pass between the strings to reach the second rotatable knob, and so that a single finger of a user's hand can reach the second rotatable knob while the user's hand remains stationary over the strings that are across the sound hole of the stringed instrument.

* * * * *